US010201194B2

(12) United States Patent
Gao et al.

(10) Patent No.: US 10,201,194 B2
(45) Date of Patent: Feb. 12, 2019

(54) PROCESS OF APPLYING A CONDUCTIVE COMPOSITE, TRANSFER ASSEMBLY HAVING A CONDUCTIVE COMPOSITE, AND A GARMENT WITH A CONDUCTIVE COMPOSITE

(71) Applicant: Tyco Electronics Corporation, Berwyn, PA (US)

(72) Inventors: Ting Gao, Palo Alto, CA (US); James Toth, San Carlos, CA (US); Jialing Wang, Mountain View, CA (US); Megan L. Hoarfrost, Belmont, CA (US); Vishrut Vipul Mehta, Santa Clara, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 144 days.

(21) Appl. No.: 14/709,169

(22) Filed: May 11, 2015

(65) Prior Publication Data

US 2016/0331044 A1 Nov. 17, 2016

(51) Int. Cl.
*A41D 13/00* (2006.01)
*A41D 1/00* (2018.01)
(Continued)

(52) U.S. Cl.
CPC ..... *A41D 1/002* (2013.01); *A41B 1/08* (2013.01); *D06M 11/83* (2013.01); *D06M 23/00* (2013.01);
(Continued)

(58) Field of Classification Search
CPC ..... A41D 1/002; A41B 1/08; D06M 11/83; D06M 23/00; D06M 23/16; D06P 5/003;
(Continued)

(56) References Cited

U.S. PATENT DOCUMENTS 5,171,938 A * 12/1992 Katsumata ..... H01B 7/08 174/105 SC
6,397,390 B1 * 6/2002 Henderson ..... A41D 27/08 2/115
(Continued)

FOREIGN PATENT DOCUMENTS

WO WO-2008/115374 A1 9/2008

OTHER PUBLICATIONS

International Search Report for International Application No. PCT/US2016/031437, dated Aug. 2, 2016.

*Primary Examiner* — Timothy K Trieu

(57) ABSTRACT

Processes of applying conductive composites on flexible materials, transfer assemblies, and garments including conductive composites are disclosed. The processes include positioning the conductive composite relative to the flexible material, the conductive composite having a resin matrix and conductive filler, and heating the conductive composite with an iron thereby applying the conductive composite directly onto the flexible material. Additionally or alternatively, the processes include positioning the conductive composite relative to the clothing, and heating the conductive composite thereby applying the conductive composite on the clothing. The garments include the flexible material and the conductive composite positioned directly on the flexible material. The transfer assembly has the conductive composite on a transfer substrate. The transfer substrate is capable of permitting heating of the conductive composite through the transfer substrate, the heating being at a temperature that permits applying the conductive composite to the flexible material.

15 Claims, 1 Drawing Sheet

(51) Int. Cl.

| | |
|---|---|
| ***D06P 5/24*** | (2006.01) |
| ***D06M 11/83*** | (2006.01) |
| ***D06M 23/16*** | (2006.01) |
| ***A41B 1/08*** | (2006.01) |
| ***D06M 23/00*** | (2006.01) |
| ***D21H 25/04*** | (2006.01) |
| ***H01B 1/22*** | (2006.01) |

(52) U.S. Cl.
CPC ..... *D06M 23/16* (2013.01); *D06P 5/003* (2013.01); *D21H 25/04* (2013.01); *H01B 1/22* (2013.01)

(58) Field of Classification Search
CPC ..... D21H 25/04; H01B 1/02; H01B 1/026; H01B 1/22
USPC ..... 2/69
See application file for complete search history.

(56) References Cited

U.S. PATENT DOCUMENTS

| | | | | |
|---|---|---|---|---|
| 6,409,942 | B1 * | 6/2002 | Narkis | C08F 283/00 252/511 |
| 7,749,581 | B2 * | 7/2010 | Dalvey | B41M 5/0256 156/235 |
| 2007/0172609 | A1 * | 7/2007 | Williams | B41M 5/502 428/32.51 |
| 2007/0218258 | A1 | 9/2007 | Nees et al. | |
| 2011/0062134 | A1 | 3/2011 | Lochtman et al. | |
| 2011/0305006 | A1 * | 12/2011 | Hehenberger | A41D 13/01 362/103 |
| 2014/0189928 | A1 * | 7/2014 | Oleson | A61B 5/6823 2/69 |
| 2014/0213844 | A1 * | 7/2014 | Pilla | A61N 2/006 600/14 |

* cited by examiner

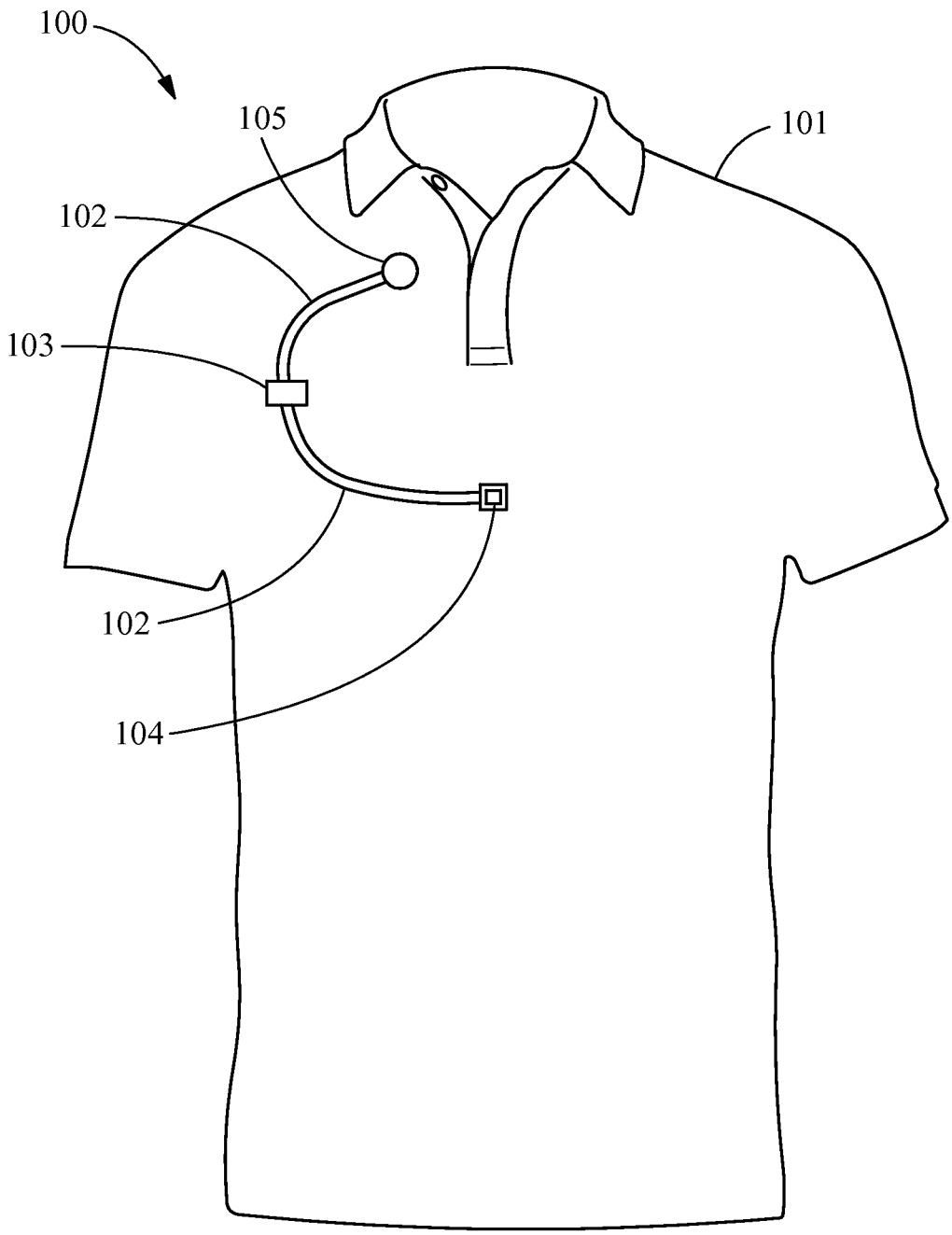
100
105
101
102
103
102
104

PROCESS OF APPLYING A CONDUCTIVE COMPOSITE, TRANSFER ASSEMBLY HAVING A CONDUCTIVE COMPOSITE, AND A GARMENT WITH A CONDUCTIVE COMPOSITE

FIELD OF THE INVENTION

The present invention is directed to conductive composites on flexible materials. More particularly, the present invention is directed to processes of applying conductive composites, transfer assemblies having conductive composites, and garments having conductive composites.

BACKGROUND OF THE INVENTION

Wearable electronics are becoming more and more desired. Individuals are constantly finding the need to have more information about themselves, as evidenced by the increase in availability and purchase of devices that monitor steps, heart-rates, elevation changes, and other activities. Similarly, devices capable of displaying information in a unique manner are highly desired. For example, interactive display systems in fixed or rigid media are growing in popularity throughout the world.

In the past, the ability to apply electronic components to flexible materials, such as wearable clothing, has been limited by the materials. Some conductive materials are not flexible and are susceptible to fracture and/or delamination. Other conductive materials are extremely expensive, rare, and/or toxic.

Past attempts to apply conductive components to flexible materials have required complicated techniques. For example, some conductive components have been assembled in a separate and relatively rigid material that is then secured to the flexible materials, thereby substantially limiting the flexibility of the resulting assembly. Other conductive components required use of interlayers and/or adhesives.

A process of applying a conductive composite, a transfer assembly having a conductive composite, and a garment having a conductive composite that show one or more improvements in comparison to the prior art would be desirable in the art.

BRIEF DESCRIPTION OF THE INVENTION

In an embodiment, a process of applying a conductive composite on a flexible material includes positioning the conductive composite relative to the flexible material, the conductive composite having a resin matrix and conductive filler, and heating the conductive composite with an iron thereby applying the conductive composite directly onto the flexible material.

In another embodiment, a process of applying a conductive composite to clothing includes positioning the conductive composite relative to the clothing, and heating the conductive composite thereby applying the conductive composite on the clothing.

In another embodiment, a transfer assembly includes a transfer substrate and a conductive composite positioned on the transfer substrate. The transfer substrate is capable of permitting heating of the conductive composite through the transfer substrate, the heating being at a temperature that permits applying the conductive composite to a flexible material.

In another embodiment, a garment includes a flexible material, and a conductive composite positioned directly on the flexible material, the conductive composite having a resin matrix and conductive filler.

Other features and advantages of the present invention will be apparent from the following more detailed description, taken in conjunction with the accompanying drawings which illustrate, by way of example, the principles of the invention.

BRIEF DESCRIPTION OF THE DRAWINGS

FIG. 1 is a perspective view of an embodiment of a garment having a conductive composite applied according to an embodiment of the disclosure.

DETAILED DESCRIPTION OF THE INVENTION

Provided are a process of applying a conductive composite, a transfer assembly having a conductive composite, and a garment having a conductive composite. Embodiments of the present disclosure, for example, in comparison to concepts failing to include one or more of the features disclosed herein, permit expanded use of wearable electronics, permit further monitoring of activities through wearable electronics (for example, number of steps, heart-rate, elevation changes, and other activities), permit expanded availability for display of information, permit a reduction or elimination in fracture and/or delamination, permit use of different materials (for example, less expensive, more available, and/or less hazardous), permit simplification of assembly, permit conductive materials to be applied directly to flexible materials, or permit a combination thereof.

FIG. 1 shows an assembly 100, specifically, having a flexible material 101 with a conductive composite 102 (for example, a polyvinyl-acetate-based composite or a polyethylene-vinyl-acetate-based composite) positioned on the flexible material 101. As will be appreciated, the assembly 100 is capable of being a shirt, pants, a coat, a dress, undergarments, a hat, or a combination thereof. Alternatively, the assembly 100 is capable of being any suitable flexible assembly, such as, a curtain, a flag, paper, a scarf, gloves, and/or a covering. In another embodiment, the assembly 100 is on a rigid surface, such as, on a refrigerator, a clothes washer, a clothes dryer, a dish washer, a door, a wall, a relatively inaccessible surface, or a combination thereof. The flexible material 101 is any material compatible with the conductive composite 102. Suitable materials include, but are not limited to, cotton, paper, polyester, cloth, fabric, hemp, cellulosic material, other suitable surfaces used for the applications referenced herein, or a combination thereof.

According to an embodiment of the disclosure, the conductive composite 102 is positioned relative to the flexible material 101 to produce the assembly 100. Upon being positioned, the conductive composite 102 is heated with an iron thereby applying the conductive composite 102 directly onto the flexible material 101. As used herein, the term "applying" refers to an action of causing a material to at least partially adhere to a substrate.

In one embodiment, the iron is a home-use iron and the heating by the iron is at a temperature of at least 100° C., at least 150° C., at least 180° C., between 100° C. and 250° C., between 150° C. and 250° C., between 180° C. and 220° C., between 180° C. and 200° C., between 200° C. and 220° C., or any suitable combination, sub-combination, range, or sub-range therein. In one embodiment, the iron is a commercial/industrial iron and the heating by the iron is within a temperature range of at least 220° C., at least 250° C., between 220° C. and 360° C., between 250° C. and 350° C., between 250° C. and 300° C., between 300° C. and 350° C., or any suitable combination, sub-combination, range, or sub-range therein.

In one embodiment, the conductive composite 102 is applied from a transfer assembly (not shown). The transfer assembly is capable of including a transfer substrate and a conductive composite positioned on the transfer substrate. The transfer substrate is capable of permitting heating of the conductive composite 102 through the transfer substrate, the heating being at a temperature that permits applying the conductive composite 102 to the flexible material 101. Thus the process comprises positioning the conductive composite on a transfer substrate prior to being positioned on the flexible material, and heating the conductive composite through the transfer substrate.

In one embodiment, upon being applied to the flexible material 101, the conductive composite 102 forms a portion or all of an electronic system. For example, one suitable electronic system is a circuit. Another suitable electronic system is a sensor. Other suitable systems include, but are not limited to, display devices.

To achieve the functionality of the desired system, the assembly 100 includes any suitable components in electrical communication with the conductive composite 102. Referring to FIG. 1, in one embodiment, the assembly 100 includes a sensor 103, a light source 104 (for example, a light emitting diode or an organic light emitting diode), and a power source 105 (for example, a battery). Other suitable elements of the assembly 100 include, but are not limited to, transceivers (for example, infrared transceivers), switches, cables, electrical connectors, terminals (for example, directly connecting electronic components to the conductive composite 102 by electrically connecting the conductive composite to a contact terminal by local heating of the conductive composite 102 while the conductive composite 102 is in contact with the contact terminal and/or without soldering), capacitors, resistors, and any other suitable elements for an electronic component.

The conductive composite 102 includes a resin matrix and a conductive filler or fillers, with or without one or more additives to provide properties corresponding with the desired application. Although not intending to be bound by theory, according to one embodiment, such properties are based upon the composition of the conductive composite 102 having a binary combination of copper and tin. In further embodiments, other suitable features of the conductive composite 102 are based upon the materials described hereinafter.

The conductive filler is or includes copper particles, tin particles, nickel particles, aluminum particles, carbon particles, carbon black, carbon nanotubes, graphene, silver-coated particles, nickel-coated particles, silver particles, metal-coated particles, conductive alloys, alloy-coated particles, other suitable conductive particles compatible with the resin matrix, or a combination thereof. Suitable morphologies for the conductive particles include, but are not limited to, dendrites, flakes, fibers, and spheres. Suitable resin matrices include, but are not limited to, ethylene-vinyl acetate (EVA), acrylics, polyvinyl acetate, ethylene acrylate copolymer, polyamide, polyethylene, polypropylene, polyester, polyurethane, styrene block copolymer, polycarbonate, fluorinated ethylene propylene (FEP), tetrafluoroethylene and hexafluoropropylene and vinylidene fluoride terpolymer (THV), silicone, or the combinations thereof.

Suitable resistivity values of the conductive composite 102 include being less than 15 ohm·cm (for example, by having carbon black) or being less than 0.05 ohm·cm (for example, by including materials disclosed herein), such as, being less than 0.01 ohm·cm, being between 0.0005 ohm·cm and 0.05 ohm·cm, or being between 0.0005 ohm·cm and 0.01 ohm·cm, depending upon the concentration of the conductive filler and the types of the resin matrices. As used herein, the term "resistivity" refers to measurable values determined upon application to the flexible material 101 by using a four-point probe in-plane resistivity measurement. In one embodiment, the conductive composite has at least 1% and/or at least 10% of the conductivity of the international annealed copper standard.

The conductive composite 102 has a thickness, for example, of between 0.04 mm and 2 mm, 0.04 mm and 1.6 mm, 0.05 mm, 0.5 mm, 1 mm, 1.5 mm, or any suitable combination, sub-combination, range, or sub-range therein. Other suitable thickness of the conductive composite 102 include, but are not limited to, between 0.04 mm and 0.1 mm, between 0.07 mm and 0.5 mm, between 0.1 mm and 0.5 mm, between 0.2 mm and 0.5 mm, greater than 0.1 mm, greater than 0.2 mm, greater than 0.4 mm, or any suitable combination, sub-combination, range, or sub-range therein.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A process of applying a conductive composite on a flexible material of a garment, comprising:

positioning the conductive composite relative to the flexible material, the conductive composite having (a) a resin matrix and conductive filler, said conductive filler being conductive particles having a morphology that is dendrites, and (b) a resistivity of less than 0.05 ohm-cm; and heating the conductive composite with an iron thereby applying the conductive composite directly onto the flexible material, further comprising positioning the conductive composite in contact with a contact terminal and making an electrical connection between the conductive composite and the contact terminal during the heating of the conductive composite; wherein the conductive composite includes ethylene-vinyl acetate (EVA), acrylic, polyvinyl acetate, ethylene acrylate copolymer, polyamide, polyethylene, polypropylene, polyester, polyurethane, styrene block copolymer, polycarbonate, fluorinated ethylene propylene (FEP), tetrafluoroethylene/hexafluoro-propylene/vinylidene fluoride terpolymer (THY), or silicone.

2. The process of claim 1, wherein the heating by the iron is within a temperature range of between 180° C. and 220° C.

3. The process of claim 1, wherein the heating by the iron is within a temperature range between 220° C. and 360° C.

4. The process of claim 1, wherein the applying of the conductive composite forms at least a portion of a circuit.

5. The process of claim 1, wherein the applying of the conductive composite forms at least a portion of a sensor.

6. The process of claim 1, wherein the conductive filler includes a binary combination of copper and tin.

7. The process of claim 1, wherein the conductive composite has at least 1% of the conductivity of the international annealed copper standard.

8. The process of claim 1, wherein the conductive composite has at least 10% of the conductivity of the international annealed copper standard.

9. The process of claim 1, wherein the conductive composite is polyvinyl-acetate-based.

10. The process of claim 1, wherein the conductive composite is polyethylene-vinyl-acetate-based.

11. The process of claim 1, wherein the flexible material comprises cotton.

12. The process of claim 1, wherein the flexible material comprises paper.

13. The process of claim 1, wherein the flexible material is a shirt.

14. A process of applying a conductive composite to clothing, comprising: positioning the conductive composite relative to the clothing, said conductive composite having (a) a resin matrix and conductive filler, said conductive filler being conductive particles having a morphology that is dendrites, and (b) a resistivity of less than 0.05 ohm-cm; and heating the conductive composite thereby applying the conductive composite on the clothing, further comprising positioning the conductive composite in contact with a contact terminal and making an electrical connection between the conductive composite and the contact terminal during the heating of the conductive composite; wherein the conductive composite includes ethylene-vinyl acetate (EVA), acrylic, polyvinyl acetate, ethylene acrylate copolymer, polyamide, polyethylene, polypropylene, polyester, polyurethane, styrene block copolymer, polycarbonate, fluorinated ethylene propylene (FEP), tetrafluoroethylene/hexafluoropropylene/vinylidene fluoride terpolymer (THY), or silicone.

15. A garment, comprising: a flexible material; and a conductive composite positioned directly on the flexible material, the conductive composite having (a) a resin matrix and conductive filler, said conductive filler being conductive particles having a morphology that is dendrites, and (b) a resistivity of less than 0.05 ohm-cm;

attaching said conductive composite on the flexible material by heating process, further comprising positioning the conductive composite in contact with a contact terminal and making an electrical connection between the conductive composite and the contact terminal during the heating of the conductive composite; wherein the conductive composite includes ethylene-vinyl acetate (EVA), acrylic, polyvinyl acetate, ethylene acrylate copolymer, polyamide, polyethylene, polypropylene, polyester, polyurethane, styrene block copolymer, polycarbonate, fluorinated ethylene propylene (FEP), tetrafluoroethylene/hexafluoro-propylene/vinylidene fluoride terpolymer (THY), or silicone.

* * * * *